United States Patent [19]

Woodling

[11] 4,368,012

[45] Jan. 11, 1983

[54] FLUID PRESSURE ASSEMBLY HAVING A VALVE DISK MEMBER WITH IDENTICAL FLAT SIDES

[76] Inventor: George V. Woodling, 22077 Lake Rd., Rocky River, Ohio 44116

[21] Appl. No.: 216,856

[22] Filed: Dec. 15, 1980

Related U.S. Application Data

[63] Continuation of Ser. No. 58,788, Jul. 19, 1979, abandoned.

[51] Int. Cl.[3] ..... F01C 1/10; F03C 2/08; F04C 2/10

[52] U.S. Cl. ..... 418/61 B; 137/625.21

[58] Field of Search ..... 418/61 B, 179; 137/625.21

[56] References Cited

U.S. PATENT DOCUMENTS

| | | | |
|---|---|---|---|
| 924,382 | 6/1909 | Reynolds | 137/625.21 |
| 986,284 | 3/1911 | Harkins | 137/625.21 |
| 3,288,034 | 11/1966 | White, Jr. et al. | 418/61 B |
| 3,853,436 | 12/1974 | Ohrberg | 418/61 B |
| 3,862,814 | 1/1975 | Swedberg | 418/61 B |

FOREIGN PATENT DOCUMENTS

| | | | |
|---|---|---|---|
| 1178893 | 1/1970 | United Kingdom | 418/61 B |

*Primary Examiner*—John J. Vrablik

*Attorney, Agent, or Firm*—Woodling, Krost & Rust

[57] ABSTRACT

In a fluid pressure assembly having a valve disk member with substantially identical flat sides which comprises a part of a fluid valve mechanism. A valve housing, being another part of the valve mechanism, includes an integral hollow wall which provides an outer valve chamber and an inner valve chamber oppositely pressurized from fluid ports. The hollow wall axially terminates in a hollow blank surface of soft metal, being the same as that of the valve housing.

The valve disk member is treated for hardness and has a valve disk side which sealingly engages a stationary valve face of a stationary valve member and a ring disk side which sealingly rubs against the soft metal of the hollow blank surface, whereby the soft metal is wearable thereby to provide a close tolerance factor to prevent leakage.

2 Claims, 7 Drawing Figures

FLUID PRESSURE ASSEMBLY HAVING A VALVE DISK MEMBER WITH IDENTICAL FLAT SIDES

This is a continuation, of application Ser. No. 58,788 filed July 19, 1979, now abandoned.

The present invention relates to a valve disk member in a fluid pressure assembly. The valve disk member comprises a part of an interface fluid valve mechanism with which it will be described.

As will be seen, the valve disk member has substantially identical flat sides. One of the identical sides is being referred to as a valve disk side, as it operates as a valve surface. The other identical side is being referred to as a ring disk side, as it operates as a narrow ring blank surface being but a small area of the entire side.

The valve housing in which the valve disk member operates has an integral hollow separating wall which provides an outer and an inner valve chamber. In operation, the valve chambers are disposed to be oppositely pressurized, whereby when one is a pressurized chamber the other one is an exhaust chamber. The hollow separating wall axially terminates in a hollow blank surface. It is to be noted that this hollow blank surface is formed of soft metal, being integral with the valve housing.

The valve disk member is arranged to be mounted between the hollow blank surface and a stationary valve face of a stationary valve member. The entire valve disk side is disposed to sealingly engage the stationary valve face and defines therewith an interface valve area. The narrow ring blank surface is disposed to sealingly rub against the hollow blank surface and defines therewith an interface blank area. The interface valve area is large in comparison to the interface blank area.

The valve disk side and the ring side of the valve disk member may be treated for hardness in the same treatment operation. Accordingly, both sides of the valve disk member have substantially the same hardness value for resisting wear. Since the narrow ring blank surface comprises a part of the ring disk side, it is noted that it is likewise wear resisting. The stationary valve face is also treated for hardness so that it may resist wear.

By reason of the fact that the area and resistance to frictional wear are large, the stationary valve face and the valve disk side are substantially free from frictional wear. The soft metal of the hollow blank surface is, however, subject to wear by the hard narrow ring blank surface, being a condition desired by the present invention.

The ease of manufacture and the substantial identity of the flat disk sides are factors which make the valve disk member ideal for production. The grinding operation for rendering the identical sides flat and parallel is very simple and free from trouble which is usually encountered in such operation. For example, there is no tendency for the flat sides to slide or skid on a magnetic holding chuck as they are being ground. Then, too, the valve disk member may be originally manufactured by a simple stamping operation, since it has an appearance like a thin wafer with identical flat sides.

An object of the present invention is to provide a valve disk member with substantially identical flat sides.

Another object is provide a hollow separating wall integral with the valve housing and functioning as a separating wall for the valve chambers.

Another object is to provide a hollow blank surface on the terminating end of the hollow separating wall.

Another object is to make the hollow blank surface of soft metal, the same as that for the valve housing.

Another object is to treat both sides of the valve disk member for hardness in one operation.

Another object is to utilize a narrow ring blank surface on one side of the valve disk member as a wear-resisting surface, being but a small area of the entire side.

Another object is to provide for wearing in the soft metal of the hollow blank surface against the wear-resisting surface.

Another object is to provide a valve disk member that is easy to manufacture on a production basis.

SUMMARY OF THE INVENTION

The invention constitutes a fluid pressure assembly having external fluid ports, an interface fluid valve mechanism comprising a valve housing including an axially extending hollow separating wall integrally connected at one end to said valve housing and axially terminating at its other end in a hollow blank surface, said hollow separating wall providing an outer and an inner valve chamber disposed to be oppositely pressurized from said fluid ports, a valve disk member disposed for actuation, a stationary valve member having a stationary valve face disposed substantially parallel to said hollow blank surface and being axially spaced therefrom, said valve disk member being disposed between said stationary valve face and said hollow blank surface, said stationary valve member being provided with a plurality of fluid conducting openings terminating in said stationary valve face, said valve disk member having substantially identical flat sides, one of said sides being referred to as a valve disk side sealingly engaging said stationary valve face and defining therewith an interface valve area, the other of said sides being referred to as a ring disk side and having a narrow ring blank surface sealingly rubbing against said hollow blank surface and defining therewith an interface blank area, said valve disk member having outer and inner fluid conducting spaces extending from one side thereof to the other side and being adapted to connect communicately said outer and inner valve chambers to said fluid conducting openings in said stationary valve face, said narrow ring blank surface being disposed intermediate said outer and inner fluid conducting spaces and defining an outwardly radially extending surface exposed to fluid pressure in said outer valve chamber and an inwardly radially extending surface exposed to fluid pressure in said inner valve chamber.

BRIEF DESCRIPTION OF THE DRAWINGS

Other objects and a fuller understanding of this invention may be had by referring to the following description and claims, taken in conjunction with the accompanying drawings, in which:

DESCRIPTION OF THE PREFERRED EMBODIMENT

Figure 1:
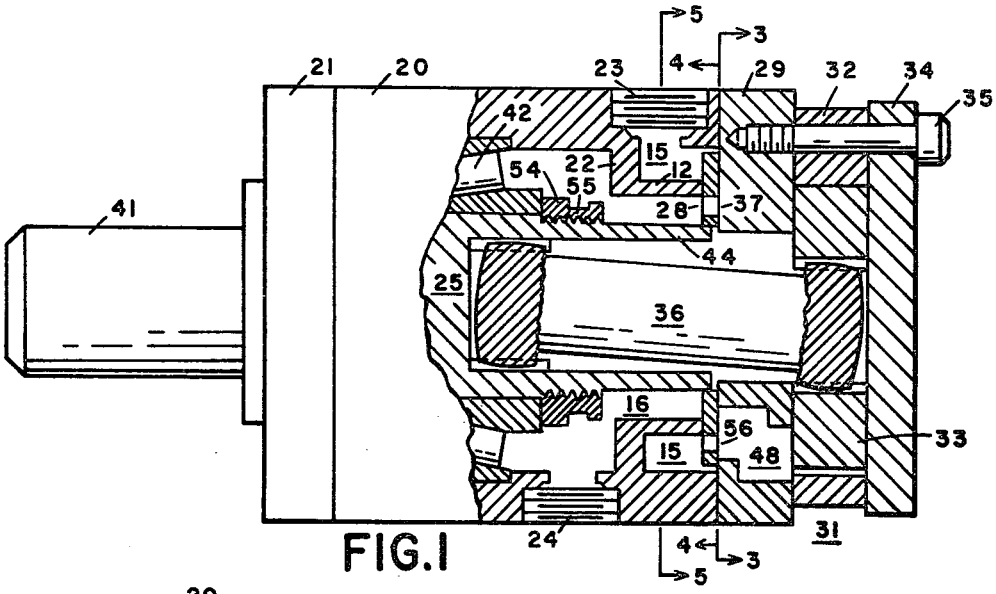
FIG. 1 is a partial, elongated sectional view of a fluid pressure assembly, embodying the features of the invention, the section through the valve being taken along the line 1—1 of FIG. 4.
Figure 2:
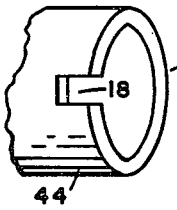
FIG. 2 is a representation of a male shank provided on a terminal end portion of a hollow shaft adapted to slideably fit within a female socket in the valve disk member and make a nonrotative connection therewith, the male shank being rotated 90 degrees from the position shown in FIG. 1.
Figure 3:
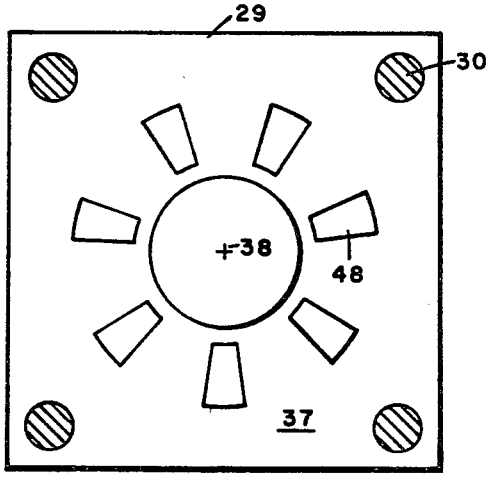
FIG. 3 is a view of the front side of the stationary valve member, taken along the line 3—3 of FIG. 1.

The fluid pressure assembly comprises generally a main housing 20 having substantially a square cross-section. A mounting flange 21 may be secured to the left-hand end of the housing by means of suitable screws, not shown. The housing is hollow from end-to-end and intermediate the ends of the housing there is provided an internal wall 22 generally separating the hollow housing into a lefthand end compartment and a right-hand end compartment. Extending from the internal wall 22 is a hollow separating wall 12 terminating in a hollow blank surface 14. The hollow separating wall 12 is integral with main housing 20 and so is the hollow blank surface 14.

Rotatively mounted in the lefthand end compartment is a main load shaft 25 having an axis substantially coinciding with the longitudinal axis of the fluid pressure assembly. The main shaft 25 comprises an enlarged internal portion having a reduced external portion 41 extending axially outwardly of the main housing through the mounting flange 21. The enlarged internal portion of the main shaft is supported preferably by tapered roller bearings 42 and 43 which provide end thrust as well as radial thrust. A tightening nut 54 which threadably engages male threads 55 secures the bearings 42 and 43 against axial movement upon the main shaft. The tightening nut 54 may be provided with a built-in locking feature to prevent loosening.

The righthand end compartment comprises a valve compartment having an open end against which a square stationary valve member 29 is mounted by means of screws 30. The stationary valve member 29 has a stationary valve face 37 disposed substantially parallel to the hollow blank surface 14 and is axially spaced therefrom. In the valve compartment and between the stationary valve face 37 and the hollow blank surface 14, there is mounted a rotary valve disk member 28 adapted to be rotated relative to the stationary valve face 37 for controlling the entrance of fluid to and the exit of fluid from a gerotor 31 comprising a stator 32 and a rotor 33. In operation, the stator 32 and the rotor 33 form expandable and contractible piston chambers. An end cap 34 encloses the stator 32 and the rotor 33, all being secured to the stationary valve member 29 by means of screws 35. Fluid is delivered to and from the housing 20 through a pair of fluid ports 23 and 24. An interconnecting wobble shaft 36 interconnects the rotary valve disk member 28 and the rotor 33, whereby the rotary valve disk member is rotated at the same speed as that of the rotor 33.

The bearings 42 and 43 constitute a common bearing means for the main shaft 25 and the rotary valve disk member 28. The common bearing means directly supports the main shaft 25 and indirectly supports the rotary valve disk member 28 through extension drive means comprising a hollow shaft 44 integrally connected to the main shaft 25. The hollow shaft 44 extends into the valve compartment to make a driving connection with the rotary valve disk member 28 for driving same. The hollow shaft 44 terminates with a male shank 45 which slideably fits within a female socket 46 provided in the rotary valve disk member 28; see FIG. 5. This connection comprises a non-rotative connection consisting of a tongue 17 fitting into an axial slot 18 and rotates the rotary valve disk member 28 upon rotation by the main shaft. This connection also provides slideable axial movement between the rotary valve disk member 28 and the hollow shaft 44 to accommodate for axial movement of the main shaft without interfering with the operation of the rotary valve disk member 28.

The stationary valve member 29 is positioned on a longitudinal axis 38 about which the rotary valve disk member rotates. It is disposed between the rotary valve disk member 28 and the gerotor 31 and is provided with a plurality of fluid conducting openings 48 arranged in a ring about the axis 38 and in constant fluid communication with the piston chambers.

Figure 4:
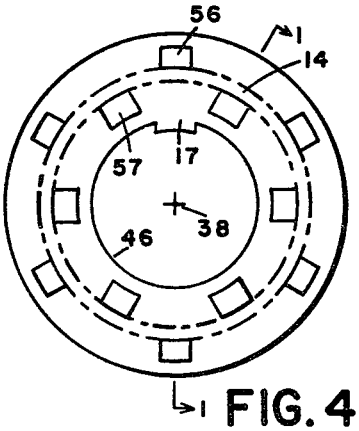
FIG. 4 is a view of the valve disk side of the valve disk member, taken along the line 4—4 of FIG. 1, the area between the two concentric dash-dot lines representing an outline of the narrow ring blank surface on the opposite side of the valve disk member.
Figure 7:
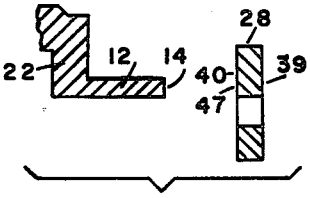
FIG. 7 shows an enlarged cross-sectional view of the top half of the integral hollow wall and the valve disk member in FIG. 1, the view being separated from each other but tied together by a bracket to facilitate the placing of additional reference numbers on the separated parts.
Figure 5:
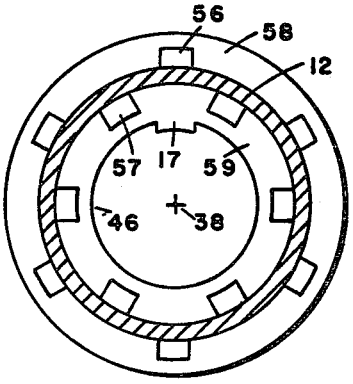
FIG. 5 is a view, taken along the line 5—5 of FIG. 1, showing the ring disk side of the valve disk member, the circular cross-section representing that of the integral hollow-wall and the rectangular blocks representing fluid conducting spaces or openings extending from one side of the valve disk member to the other side.

As illustrated in FIGS. 4 and 5, the rotary valve disk member 28 has substantially identical flat sides 39 and 40. The side 39 may be referred to as a valve disk side, as it operates as a valve surface. The side 40 may be referred to as a ring disk side, of which only a narrow ring blank surface 47 is utilized, being small in area. The entire valve disk side 39 is disposed to sealingly engage the stationary valve face 37 and defines therewith a commutating interface valve comprising a large interface valve area. The narrow ring blank surface 47 is disposed to sealingly rub against the hollow blank surface 14. The narrow ring blank 47 is continuously circular and defines in combination with the hollow blank surface 14 a small interface blank areas as compared to the large interface valve area.

The hollow separating wall 12 provides an outer valve chamber 15 and an inner valve chamber 16, disposed to be oppositely pressurized from the fluid ports 23 and 24, whereby when one is pressurized the other is at exhaust pressure.

As shown in FIGS. 4 and 5, the rotary valve disk member 28 has an outer series of commutating fluid passages 56 and an inner series of commutating fluid passage 57. The fluid passages extend from one side to the other side of the rotary disk member and are alternately disposed with respect to each other. The passages are adapted to connect commutatively the outer and inner valve chambers 15 and 16 to the fluid conducting openings 48 in the stationary valve face 37 during rotation of the rotary valve disk member 28. The fluid passages in each series are one less in number than the number of the fluid conducting openings 48 in the stationary valve face.

Figure 6:
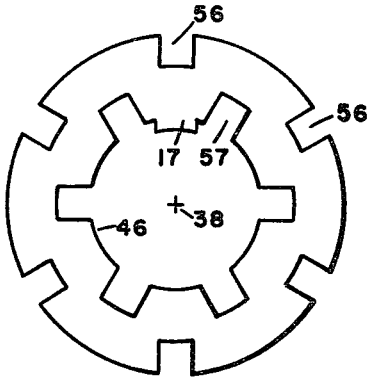
FIG. 6 is a view similar to FIG. 5, but shows fluid conducting slots instead of the rectangular fluid conducting spaces.

In FIGS. 4 and 5, the outer and inner series of fluid passages 56 and 57 are shown as defining rectangular conducting openings or spaces. In FIG. 6, the outer and inner series of fluid conducting spaces are shown as defining fluid slots.

In the claims, the series of fluid passages are referred to as fluid conducting spaces which include both the rectangular openings in FIGS. 4 and 5 and the fluid slots in FIG. 6.

In practice, the valve disk side 39 and the ring disk side 40 may be treated for hardness in the same treatment operation. Accordingly, both sides of the valve disk member have substantially the same hardness value for resisting wear which means that the narrow ring blank surface 47 is likewise of the same hardness. This is a desired feature of the invention, as it comprises a simple operation. The stationary valve face 37 is also treated for hardness so that it may resist wear.

As previously noted, the valve disk side 39 and the stationary valve face 37 are substantially free from frictional wear, as these surfaces have a large resistance to wear, plus a large area.

As desired by the present invention, the blank seal surface 14 is subject to wear, being made of soft metal the same as the valve housing 20. In assembly, the soft metal rubs against the hard narrow ring blank surface 47 and is wearable thereby to provide an ideal tolerance space therebetween which stops wearing the instant that the hydraulic fluid begins to seep between the hard and soft metal surfaces.

Since the hard narrow ring blank surface 47 is disposed intermediate the fluid passages 56 and 57, the outer radially extending part of the ring disk side 40, being identified by the reference number 58 is exposed to fluid pressure in the outer valve chamber 15 and, similarly, the inner radially extending part 59 is exposed to fluid pressure in the inner valve chamber 16. This is a desired aspect of the invention and tends to provide a fluid force in a direction to urge the valve disk side 39 against the stationary valve face 37 to prevent interface valve leakage and to urge the ring disk side 40 away from the soft metal of the hollow blank surface 14 to prevent further wear. The tolerance factor as it wears in always comes out ideal; namely, to what the situation calls for, regardless of production variations in the degree of the tightness of the metal-to-metal fit when initially assembled. Production-wise the degree of the initial fit is not critical, so long as there is some soft metal to wear in. The quality of the initial fit need not be held to such close tolerances as that required for lapping. A turning machine cut finish makes a very good base surface for the initial fit and subsequent burnishing which takes place.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a fluid pressure assembly including outer and inner relatively rotatable body members forming expandable and contractable piston chambers and including oppositely pressurized fluid ports whereby when one is pressurized the other is at an exhaust pressure, said body members each having a body axis, said body axis of one of said rotatable body members being referred to as a reference axis, a fluid valve mechanism for commutatively connecting said piston chambers in fluid communication with said fluid ports and including a reference body encompassing said reference axis, a rotary valve member rotatable about said reference axis, a stationary valve member having a stationary valve face axially spaced from said reference body, said stationary valve member being positioned on said reference axis between said rotary valve member and said piston chambers and being provided with a plurality of fluid conducting openings arranged in a ring about said reference axis and in constant fluid communication with said piston chambers, said rotary valve member being disposed between said stationary valve face and said reference body and having a central drive socket, a load shaft driven by said inner rotatable body member, said load shaft including a shaft extension axially extending into said central drive socket of said rotary valve member and defining a non-rotatable drive connection therewith for driving same, said rotary valve member comprising a round wafer body having identical flat wafer sides, said wafer body having an axial width extending from said stationary valve face to said reference body, one of said wafer sides being referred to as a valve side sealingly engaging said stationary valve face and defining therewith a commutating interface valve having a large interface area, the other of said wafer sides being referred to as a ring side including a ring seal portion sealingly engaging said reference body and defining therewith an interface fluid seal having a small interface area as compared to that of said commutating interface valve, said ring side of said wafer body having a radially extending outer ring part exposed to fluid pressure in one of said fluid ports and a radially extending inner ring part exposed to fluid pressure in the other of said fluid ports, said wafer body having an outer and an inner series of commutating fluid conducting spaces extending transversely therethrough, said outer series extending transversely from said outer ring part to said valve side and being arranged in an outer ring about said reference axis, said inner series extending transversely from said inner ring part to said valve side and being arranged in an inner ring about said reference axis, said outer and inner series of fluid conducting spaces being alternately disposed in a circumferential direction with respect to each other and being adapted to connect commutatively said fluid ports to said fluid conducting openings in said stationary valve face, said ring seal portion comprising a circular blank surface disposed radially between said outer and inner series of said fluid conducting spaces, said fluid conducting spaces in each of said series being one less in number than the number of said fluid conducting openings in said stationary valve face, each of said fluid conducting spaces being defined by a fluid conducting transverse wall extending through said wafer body, said transverse wall being aligned in a direction perpendicular to said identical sides of said wafer body to facilitate ease of manufacture of said wafer body on a production basis.

2. A rotary piston machine including an outer stationary body member having a stationary axis, an inner rotary body member having a rotary axis, and a housing having oppositely pressurized fluid ports whereby when one port is pressurized the other port is at exhaust pressure, said outer stationary body member and said inner rotary body member forming expandable and contractible piston chambers, a fluid valve mechanism for commutatively connecting said piston chambers to said fluid ports, said valve mechanism including a rotary valve member, a stationary valve member, and a load shaft driven by said inner rotary body member, said rotary valve member having a central socket, said load shaft having a portion thereof fitting within said central socket and providing a non-rotatable connection therebetween for driving said rotary valve member relative to said stationary valve member, said stationary valve member being positioned on said stationary axis between said rotary valve member and said piston chambers and being provided with a plurality of fluid openings arranged at spaced circumferential intervals around said stationary axis, said fluid openings being in constant fluid communication with said piston chambers, said fluid valve mechanism further including an outer fluid valve chamber in constant fluid communication with one of said fluid ports and an inner fluid valve chamber in constant fluid communication with the other of said ports, an internal wall with a flat ring face thereon for sealingly separating said fluid valve chambers, said rotary valve member comprising a longitudinally thin wafer body having flat sides, one of said flat sides having a rotating valve face sealingly engaging said stationary valve member and defining therewith a commutating valve of a large interface area, the other side of said flat sides having a seal ring face sealingly engaging said flat ring face and defining therewith an interface ring seal of a small interface area as compared to that of said commutating interface valve, said rotary valve member having a first series of commutating fluid passages extending from said outer fluid valve chamber to said rotating valve face and having a second series of commutating fluid passages extending from said inner fluid valve chamber to said rotating valve face, said fluid passages being adapted to connect commutatively said outer and inner valve chambers to said fluid openings in said stationary valve member during rotation of said rotary valve member, each of said commutating fluid passages defining a transverse wall extending in a perpendicular direction straight through said wafer body for ease of manufacture, said rotary valve member having an outer radially extending surface exposed to fluid pressure in said outer valve chamber and having an inner radially extending surface exposed to fluid pressure in said inner valve chamber, whereby said rotary valve member is subject to an axial fluid force tending to urge said seal ring face in a direction away from said flat ring face and said rotating valve face toward said stationary valve member.

* * * * *